US009404060B2

(12) United States Patent
Oh

(10) Patent No.: US 9,404,060 B2
(45) Date of Patent: Aug. 2, 2016

(54) DIESEL ENGINE OIL COMPOSITION FOR IMPROVING FUEL EFFICIENCY AND ENDURANCE PERFORMANCE

(71) Applicant: Hyundai Motor Company, Seoul (KR)

(72) Inventor: Jung Joon Oh, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/570,634

(22) Filed: Dec. 15, 2014

(65) Prior Publication Data

US 2016/0108336 A1 Apr. 21, 2016

(30) Foreign Application Priority Data

Oct. 15, 2014 (KR) ..... 10-2014-0139159

(51) Int. Cl.

| | |
|---|---|
| ***C10M 161/00*** | (2006.01) |
| ***C10M 135/18*** | (2006.01) |
| ***C10M 129/76*** | (2006.01) |
| ***C10M 159/24*** | (2006.01) |

(52) U.S. Cl.

CPC ..... *C10M 161/00* (2013.01); *C10M 2205/086* (2013.01); *C10M 2207/289* (2013.01); *C10M 2219/046* (2013.01); *C10M 2219/068* (2013.01); *C10N 2230/06* (2013.01); *C10N 2230/54* (2013.01); *C10N 2240/102* (2013.01)

(58) Field of Classification Search

CPC ..... C10M 161/00; C10M 2219/046; C10M 2219/068; C10M 2207/289; C10M 2205/028; C10N 2230/04; C10N 2230/10; C10N 2230/12; C10N 2240/10

USPC ..... 508/365

See application file for complete search history.

(56) References Cited

U.S. PATENT DOCUMENTS

| | | | | |
|---|---|---|---|---|
| 7,067,049 | B1 * | 6/2006 | Baillargeon | C10M 169/048 208/18 |
| 2005/0113265 | A1 * | 5/2005 | Yagishita | C10M 141/10 508/188 |
| 2006/0025313 | A1 * | 2/2006 | Boffa | C10M 163/00 508/199 |
| 2006/0276351 | A1 * | 12/2006 | Mucha | C10M 169/04 508/199 |

FOREIGN PATENT DOCUMENTS

| | | | |
|---|---|---|---|
| EP | 1 724 330 | | 11/2006 |
| JP | 2011-201962 | A | 10/2011 |
| JP | 2012-102280 | A | 5/2012 |
| KR | 10-2010-0049350 | A | 5/2010 |
| KR | 10-2011-0051852 | | 5/2011 |
| KR | 10-2012-0123304 | | 11/2012 |

* cited by examiner

*Primary Examiner* — James Goloboy

(74) *Attorney, Agent, or Firm* — Mintz Levin Cohn Ferris Glovsky and Popeo, P.C.; Peter F. Corless

(57) ABSTRACT

Disclosed is a novel diesel engine oil composition for fuel efficiency and endurance performance. The diesel engine oil composition may maximize frictional resistance and wear resistance by facilitating the formation of a lubricating film on a metal surface, extend an oil change cycle with excellent engine protection ability, and improve fuel efficiency due to friction reduction. The diesel engine oil composition include: base oil; a calcium-based or magnesium-based sulfonate detergent dispersant; a viscosity index improver selected from the group consisting of a diene copolymer, a polystyrene-diene copolymer and a hydrogenated polystyrene-diene copolymer; and a low friction agent including molybdenum dithiocarbamate (MoDTC) and glycerol monooleate (GMO).

8 Claims, 1 Drawing Sheet

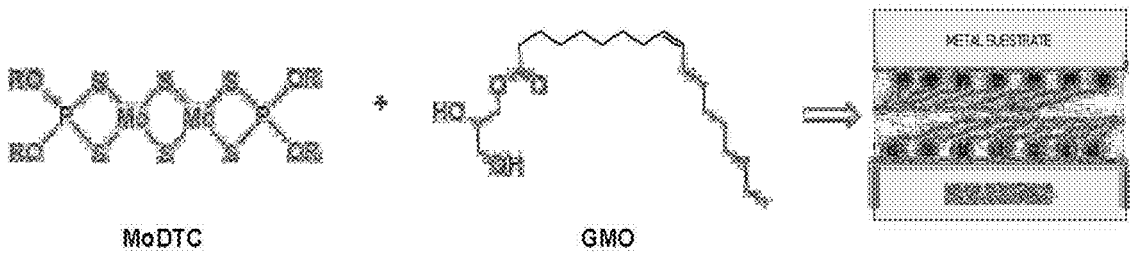
MoDTC
GMO
METAL SUBSTRATE

DIESEL ENGINE OIL COMPOSITION FOR IMPROVING FUEL EFFICIENCY AND ENDURANCE PERFORMANCE

CROSS-REFERENCE TO RELATED APPLICATION

This application claims under 35 U.S.C. §119(a) the benefit of Korean Patent Application No. 10-2014-0139159 filed on Oct. 15, 2014, the entire contents of which are incorporated herein by reference.

TECHNICAL FIELD

The present invention relates to a diesel engine oil composition for improving fuel efficiency and endurance performance.

BACKGROUND

Engine oil is used for lubricating and cooling crank mechanism and various engine parts. Accordingly, viscosity property, an extreme pressure property of lubrication performance under high loads, oxidation stability, a friction property and the like may be required for the engine oil. Typically, base oil and additives having suitable properties may be mixed in the engine oil composition to improve such performances.

Recently, regulations on vehicle exhaust gas such as carbon dioxide have become stricter for efficient energy use and global warming prevention. In response to these environment regulations, engine oil for improving fuel efficiency and reducing the energy loss of engines has been actively developed. Particularly, efforts for improving efficiency by lowering a friction coefficient with the use of low friction additives have been continuously made to reduce the friction in the mixed lubrication areas of engine valves or piston parts.

For example, in the related arts, a diesel engine oil composition has been provided and the composition includes zinc dithiophosphate (ZnDTP) and glycerol monooleate (GMO) in base oil as an antiwear agent in addition to a viscosity index improver and a detergent dispersant. However, zinc dithiophosphate may be readily decomposed at elevated temperature condition thereby increasing in the amount of ash components produced and further reducing endurance due to valve deposits in the engine.

In addition, an engine oil composition has been developed and the engine oil composition includes highly-concentrated molybdenum dithiocarbamate (MoDTP) having molybdenum content of about 9 to 15% by weight, zinc-dialkyldithiophosphate, and a calcium-based or a calcium borate-based salicylate. However, when a salicylate metal salt detergent dispersant and molybdenum dithiocarbamate are used together, metal salt deposits may be generated due to the combustion at elevated temperature condition such that its application as engine oil may be limited.

Furthermore, in another example, a gasoline engine oil composition including a molybdenum dithiocarbamate (MoDTP) or glycerol monooleate (GMO) friction modifier together with a zinc dithiophosphate (ZnDTP) antiwear agent has been introduced. In other related arts, a technology of using MoDTP or GMO as an auxiliary additive has been developed to reduce the friction which is not reduced when ZnDTP is used alone. However, such technology does not provide combined use of MoDTP and GMO for simultaneously improving frictional resistance, wear resistance and fuel efficiency.

Particularly for large size diesel engines with large loads and low speed, lowering a friction coefficient may be limited by adding a low friction agent due to relatively large mixing and fluid lubricating area parts. In addition, when viscosity is lowered for additional fuel efficiency improvement, wear resistance may deteriorate as thickness of an oil film decreases when the viscosity decrease.

The above information disclosed in this Background section is only for enhancement of understanding of the background of the invention and therefore it may contain information that does not form the prior art that is already known in this country to a person of ordinary skill in the art.

SUMMARY OF THE INVENTION

In a preferred aspect, the present invention can address one or more of the above-mentioned technical difficulties such as an antiwear performance due to viscosity decrease in an engine oil composition used for large size diesel engines. In a preferred aspect, the present invention also can improve fuel efficiency by maximizing friction reduction. In particular, when molybdenum dithiocarbamate (MoDTC) and glycerol monooleate (GMO) are added to the composition as low friction components in a particular mixing ratio in addition to base oil, a detergent dispersant and a viscosity index improver, synergistic effects between the low friction components may be obtained thereby maximizing frictional resistance and wear resistance by facilitating the formation of a lubricating film on a metal surface.

In one aspect, a novel diesel engine oil composition is provided. The diesel engine oil composition may have uniform viscosity compared to conventional engine oil thereby eliminating wear resistance reduction caused by decrease of an oil film thickness in the conventional engine oil, extending an oil change cycle with improved engine protection ability, and improving fuel efficiency due to reduced friction.

In a preferred aspect, the diesel engine oil composition may include: base oil; a calcium-based or magnesium-based sulfonate detergent dispersant; a viscosity index improver selected from the group consisting of a diene copolymer, a polystyrene-diene copolymer and a hydrogenated polystyrene-diene copolymer; and a low friction agent including molybdenum dithiocarbamate (MoDTC) and glycerol monooleate (GMO).

In an exemplary embodiment, a diesel engine oil composition may comprise: a base oil in an amount of about 75 to 85% by weight; one or more of detergent dispersants selected from the group consisting of calcium sulfonate and magnesium sulfonate in an amount of about 5 to 20% by weight; one or more of viscosity index improvers selected from the group consisting of a diene copolymer, a polystyrene-diene copolymer and a hydrogenated polystyrene-diene copolymer in an amount of about 1 to 10% by weight; and a low friction agent including molybdenum dithiocarbamate (MoDTC) and glycerol monooleate (GMO) in an amount of about 0.5 to 2% by weight, based on the total weight of the diesel engine oil composition.

It is understood that weight percents (% by weight) of the components of the oil composition as disclosed herein are based on total weight of the diesel engine oil composition, unless otherwise indicated.

The invention also provides the above oil composition that consists essentially of, or consists of the disclosed components. For example, a diesel engine oil composition is provided that consists essentially of, or consists of: a base oil in an amount of about 75 to 85% by weight; one or more of detergent dispersants selected from the group consisting of calcium sulfonate and magnesium sulfonate in an amount of about 5 to 20% by weight; one or more of viscosity index improvers selected from the group consisting of a diene copolymer, a polystyrene-diene copolymer and a hydrogenated polystyrene-diene copolymer in an amount of about 1 to 10% by weight; and a low friction agent including molybdenum dithiocarbamate (MoDTC) and glycerol monooleate (GMO) in an amount of about 0.5 to 2% by weight, based on the total weight of the diesel engine oil composition.

Further provided are vehicles that use the diesel engine oil compositions as disclosed herein. Preferred are vehicles using the diesel engine oil compositions as disclosed herein.

The above and other features of the invention are discussed infra.

BRIEF DESCRIPTION OF THE DRAWINGS

The above and other objects, features and advantages of the present invention will be more clearly understood from the following detailed description taken in conjunction with the accompanying drawings, in which:

FIG. 1 illustrates an exemplary lubricating composition including MoDTC and GMO and formation of an exemplary lubricating film on a metal surface according to an exemplary embodiment of the present invention.

It should be understood that the accompanying drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter reference will now be made in detail to various exemplary embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

A diesel engine oil composition may include: base oil, a detergent dispersant, a viscosity index improver and a low friction agent, and as the low friction agent including molybdenum dithiocarbamate (MoDTC) and glycerol monooleate (GMO). In particular, the molybdenum dithiocarbamate (MoDTC) and the glycerol monooleate (GMO) may be included in the low friction agent in an optimal mixing ratio to maximize the synergistic effects between those low friction agents.

In an exemplary embodiment, the diesel engine oil composition a may include: base oil in an amount of about 75 to 85% by weight; one or more of detergent dispersants selected from the group consisting of calcium sulfonate and magnesium sulfonate in an amount of about 5 to 20% by weight; one or more of viscosity index improvers selected from the group consisting of a diene copolymer, a polystyrene-diene copolymer and a hydrogenated polystyrene-diene copolymer in an amount of about 1 to 10% by weight; and a low friction agent including molybdenum dithiocarbamate (MoDTC) and glycerol monooleate (GMO) in an amount of about 0.5 to 2% by weight. Particularly, the low friction agent may include the molybdenum dithiocarbamate (MoDTC) and the glycerol monooleate (GMO) in a weight ratio of about 1:1 to 1:3.

It is understood that weight percents of oil components as disclosed herein are based on total weight of the engine oil composition, unless otherwise indicated.

Each component forming the diesel engine oil composition according to the present invention is described in detail as follows.

The base oil, as used herein, may be lubricating oil used for lubricating a gearing system and may prevent contact between tears and adhesion due to melting by reducing friction and wear. The base oil may have dynamic viscosity ranging from about 3 to 10 about centistock (cSt) at a temperature of about 100° C. and have viscosity index of about 100 or greater. Particularly, the viscosity index of the base oil may be in a range from about 100 to about 140. When the dynamic viscosity of the base oil is less than about 3 cSt at a temperature of about 100° C., the amount of the oil may increase due to excessive evaporation loss under elevated temperature conditions, and when the dynamic viscosity is greater than about 10 cSt, low-temperature startability may be reduced due to severe viscosity increase at lowered temperature conditions. As the base oil, one or more selected from high purity mineral oil and synthetic oil may be used. The base oil may be included in an amount of about 75 to 85% by weight in the diesel engine oil composition, and when the content is less than about 75% by weight, viscosity may significantly increase due to increase in amount of additives, and particularly, viscosity may increase substantially at lowered temperature conditions. When the content is greater than about 85% by weight, the engine oil may not function suitably due to reduced content of the additives.

The detergent dispersant, as used herein, may include a calcium-based or magnesium-based dispersant. As the detergent dispersant, one or more types selected from the group consisting of calcium sulfonate and magnesium sulfonate having a total base number of about 400 or greater or having a total base number in a range from about 400 to about 600 may be used. When metal salts used as the detergent dispersant have a total base number of less than about 400, oxidation stability of the oil may be reduced, and thus the detergent dispersant having a total base number of about 400 or greater may be used. This detergent dispersant may be included in an amount of about 5 to 20% by weight or particularly in an amount of about 12 to 17% by weight in the diesel engine oil composition. When the content of the detergent dispersant included in the diesel engine oil composition is less than about 5% by weight, extreme pressure property and wear resistance may be reduced, and when the content is greater than about 20% by weight, ash components may be produced substantially.

The viscosity index improver, as used herein, may improve a viscosity index and increases fluidity at lowered temperature conditions. The viscosity index improver may improve low-temperature fluidity, wear resistance and a fuel efficiency performance. The viscosity index improver may include a copolymer having a weight average molecular weight (Mw) ranging from about 100,000 to about 500,000, from about 180,000 to about 400,000, or particularly from 80,000 to 250,000. As the viscosity index improver, one or more types selected from the group consisting of a diene copolymer, a polystyrene-diene copolymer and a hydrogenated polystyrene-diene copolymer may be used. The diene copolymer may be, but not limited to, an ethylene-propylene copolymer. The polystyrene-diene copolymer may be, but not limited to, polystyrene-isoprene copolymer. The viscosity index improver may be included in an amount of about 1 to 10% by weight or particularly in an amount of about 3 to 7% by weight in the diesel engine oil composition. When the content of the viscosity index improver is included in the diesel engine oil composition of the present invention less than about 1% by weight, low-temperature fluidity may decrease causing the reduction of startability at lowered temperature condition, and when the content is greater than about 10% by weight, viscosity may decrease due to the shear of the viscosity index improver and viscosity may increase due to oxidation.

The low friction agent, as used herein, may include a mixture of molybdenum dithiocarbamate (MoDTC) and glycerol monooleate (GMO). As described in the related arts, the glycerol monooleate (GMO) includes the hydroxyl polar group densely adsorbed to a metal surface and the oleate nonpolar group for lubrication. However, when GMO is used singly, a friction coefficient may not be lowered sufficiently to a target level due to large loads and substantial large mixing and fluid lubricating area parts in large size diesel engines.

Accordingly, molybdenum dithiocarbamate (MoDTC) and glycerol monooleate (GMO) may be simultaneously included in the low friction agent at a particular mixing ratio. Consequently, the formation of a lubricating film may be substantially facilitated, and thus, frictional resistance and wear resistance may be maximized. As shown in FIG. 1, MoDTC and GMO included as the low friction agent may have both a polar part and a nonpolar part, and when MoDTC and GMO are simultaneously included in the lubricating composition, the polar part may be adsorbed to a metal surface and the friction of fluids may be reduced and antiwearing property may be provided by the nonpolar part working like grass.

In particular MoDTC and GMO may be included in a weight ratio of about 1:1 to about 1:3 in the low friction agent. Within the range of the mixing ratio, substantially reduced amounts of metal wear debris (Fe, Cu) may be detected after endurance, and improved diesel engine oil composition may be obtained during a piston endurance test. Meanwhile, when the mixing ratio of MoDTC and GMO is not in the range described above, density adsorbed to a metal surface may decrease, and friction may be increased due to the strong interaction between nonpolar parts. Maintaining the weight ratio of MoDTC and GMO in 1:1.1 to 1.5 is particularly favorable in terms that it is especially effective in increasing the fuel efficiency by about twice or greater compared to when GMO is used singly.

In addition, the diesel engine oil composition of the present invention may further include an antioxidant, an antifoaming agent and the like as generally used in the related arts.

The antioxidant, as used herein, may prevent engine oil oxidation and may be, but not limited to an amine-based antioxidant such as 3-hydroxydiphenylamine and phenyl-alpha-naphthylamine. The antioxidant may be included in an amount of about 0.05 to 3% by weight in the diesel engine oil composition. When the content is less than about 0.05% by weight, the antioxidation performance may deteriorate, and when the content is greater than about 3% by weight, side effects such as competitive adsorption and metal corrosion may occur.

The antifoaming agent, as used herein, may include one or more selected from silicone, polymethacrylate and the like. This antifoaming agent may be included in an amount of about 0.0005 to 2% by weight in the diesel engine oil composition. When the content is less than about 0.0005% by weight, bubble may be generated in the lubricating oil, and when the content is greater than about 2% by weight, the antifoaming property may be reduced or the antifoaming agent may be precipitated in the lubricating oil.

As such, the diesel engine oil composition of the present invention may be prepared by mixing each component as described above. The order of mixing these components may not be particularly limited, however, the additives having lower activity may be added after the base oil is prepared. When the activities of the additives are similar or same, the additives used in less amounts may be add first. When the mixture is prepared, the mixture may be stirred using a stirrer at a temperature of about 70° C. or greater, and the speed of the stirrer may be adjusted depending on the size and the design value of the stirrer. For example, when small-sized stirrers are used, the stirring speed may be of about 300 to 500 rpm, and when large-sized stirrers are used, the stirring speed may be of about 100 to 400 rpm.

The present invention will be described in more detail with reference to the following examples, however, the present invention is not limited to these examples.

EXAMPLES

Examples 1 to 3 and Comparative Examples 1 to 3 are presented as follows.

Preparation of Diesel Engine Oil Composition

A diesel engine oil composition was prepared by adding components shown in Table 1 to a reactor, and mixing the components under a condition of a temperature of about 70° C. and at a stirrer speed of about 400 rpm.

Each Component Forming Diesel Engine Oil Composition (1) Base oil: dynamic viscosity of about 3 to 10 cSt at a temperature of about 100° C.; viscosity index of 120 or greater (2) Detergent dispersant: calcium sulfonate (product of Infineum International Limited)

(3) Viscosity index improver: polystyrene-isoprene copolymer having a weight average molecular weight (Mw) of about 80,000 to 250,000

(4) Low friction agent: ① molybdenum dithiocarbamate (S525, product of Adeka Corporation)

② glycerol monooleate (GMO, product of Lubrizol Corporation)

TABLE 1

| Category (% by weight) | | Example 1 | Example 2 | Example 3 | Comparative Example 1 | Comparative Example 2 | Comparative Example 3 |
|---|---|---|---|---|---|---|---|
| Base Oil | | 79.2 | 79.2 | 79.2 | 79.2 | 79.2 | 80.2 |
| Detergent Dispersant | | 14.8 | 14.8 | 14.8 | 14.8 | 14.8 | 14.8 |
| Viscosity Index Improver | | 5 | 5 | 5 | 5 | 5 | 5 |
| Low Friction Agent | MoDTC | 0.4 | 0.5 | 0.3 | 1.0 | — | — |
| | GMO | 0.6 | 0.5 | 0.7 | — | 1.0 | — |

Test Example

Performances of each diesel engine oil composition prepared in Examples 1 to 3 and Comparative Examples 1 to 3 were tested based on general performance test methods, and the results are shown in Table 2.

Performance Test Methods (A) Dynamic viscosity: dynamic viscosity was measured using standard ASTM D 445 method.

(B) SRV friction coefficient: SRV friction coefficient was measured using standard ASTM D 6425 method.

(C) Fuel efficiency improvement rate: fuel efficiency improvement rate was measured by WHTC at certification mode.

(D) Metal wear debris: metal wear debris was measured using standard ASTM D 4951 method.

(E) Piston endurance: piston endurance was measured by CEC (M 02 A 78) method.

TABLE 2

| Evaluation Items | | Example 1 | Example 2 | Example 3 | Comparative Example 1 | Comparative Example 2 | Comparative Example 3 |
|---|---|---|---|---|---|---|---|
| Dynamic Viscosity (cSt) (100° C.) | | 13.5 | 13.5 | 13.5 | 13.4 | 13.5 | 13.4 |
| SRV Friction Coefficient (100° C.) | | 0.048 | 0.054 | 0.055 | 0.062 | 0.065 | 0.120 |
| Fuel Efficiency Improvement Rate (Engine Test) | | 0.6% | 0.4% | 0.4% | 0.3% | 0.2% | Standard |
| Metal Wear (ppm) | Fe | 82 | 91 | 90 | 95 | 98 | 120 |
| | Cu | 75 | 88 | 85 | 90 | 102 | 110 |
| Piston Rating after Endurance (Score) | | 9.5 | 9.0 | 9.0 | 9.0 | 8.5 | 8.0 |

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A diesel engine oil composition, consisting of:

a base oil in an amount of about 75 to 85% by weight based on the total weight of the diesel engine oil composition;

one or more of detergent dispersants selected from the group consisting of calcium sulfonate and magnesium sulfonate in an amount of about 5 to 20% by weight based on the total weight of the diesel engine oil composition;

one or more of viscosity index improvers selected from the group consisting of a diene copolymer, a polystyrene-diene copolymer and a hydrogenated polystyrene-diene copolymer in an amount of about 1 to 10% by weight based on the total weight of the diesel engine oil composition; and a low friction agent including molybdenum dithiocarbamate (MoDTC) and glycerol monooleate (GMO) in an amount of about 0.5 to 2% by weight based on the total weight of the diesel engine oil composition.

2. The diesel engine oil composition of claim 1, wherein the low friction agent include the molybdenum dithiocarbamate (MoDTC) and the glycerol monooleate (GMO) in a weight ratio of about 1:1 to 1:3.

3. The diesel engine oil composition of claim 1, wherein the base oil is one or more selected from the group consisting of high purity mineral oil and synthetic oil having kinematic viscosity of about 3 to 10 cSt at a temperature of about 100° C. and viscosity index of about 100 or greater.

4. The diesel engine oil composition of claim 1, wherein the detergent dispersant is one or more selected from the group consisting of calcium sulfonate and magnesium sulfonate having a total base number of about 400 or greater.

5. The diesel engine oil composition of claim 1, wherein the viscosity index improver has a weight average molecular weight (Mw) ranging from about 80,000 to about 250,000, and is an ethylene-propylene copolymer, a polystyrene-isoprene copolymer, or mixtures thereof.

6. The diesel engine oil composition of claim 1, wherein the low friction agent includes molybdenum dithiocarbamate (MoDTC) and glycerol monooleate (GMO) in a weight ratio of about 1:1.1 to 1:1.5.

7. A vehicle comprising a diesel engine oil composition of claim 1.

8. A method of preparing a diesel engine oil composition of claim 1, comprising preparing a mixture, and stirring the mixture at a temperature of about 70° C. or greater.

* * * * *